US009833929B2

(12) United States Patent
Chen

(10) Patent No.: US 9,833,929 B2
(45) Date of Patent: Dec. 5, 2017

(54) TABLE TYPE CUTTER AND CUTTING WORKTABLE THEREOF

(71) Applicant: CHERVON (HK) LIMITED, Wanchai (HK)

(72) Inventor: Zhifeng Chen, Nanjing (CN)

(73) Assignee: Chevron (HK) Limited, Wanchai (HK)

( * ) Notice: Subject to any disclaimer, the term of this patent is extended or adjusted under 35 U.S.C. 154(b) by 655 days.

(21) Appl. No.: 14/289,125

(22) Filed: May 28, 2014

(65) Prior Publication Data

US 2014/0352680 A1 Dec. 4, 2014

(30) Foreign Application Priority Data

May 30, 2013 (CN) ..... 2013 1 0208515

(51) Int. Cl.
*B28D 1/04* (2006.01)
*B28D 7/04* (2006.01)

(52) U.S. Cl.
CPC ..... *B28D 1/047* (2013.01); *B28D 7/04* (2013.01); *B28D 7/043* (2013.01)

(58) Field of Classification Search
CPC ..... B28D 1/04; B28D 1/044; B28D 1/046; B28D 1/047; B28D 7/04; B28D 7/043
USPC ..... 125/13.01; 269/62, 303, 319
See application file for complete search history.

(56) References Cited

U.S. PATENT DOCUMENTS 2,931,551 A * 4/1960 Zalkind ..... B41L 1/00 225/93
3,011,366 A * 12/1961 Sandven ..... B23Q 3/00 451/367
4,315,494 A * 2/1982 DiPlacido ..... B28D 7/043 125/13.01
4,924,843 A * 5/1990 Waren ..... B28D 1/047 125/35
5,676,124 A * 10/1997 Lee ..... B28D 1/047 125/13.01
6,676,495 B1 * 1/2004 Siemers ..... B24B 3/36 451/278
7,669,841 B1 * 3/2010 Krasowski ..... B27B 21/00 269/296
7,926,477 B2 * 4/2011 Li ..... B23D 47/025 125/13.01
8,656,902 B2 * 2/2014 Wei ..... B23D 47/025 125/12

(Continued)

*Primary Examiner* — Monica Carter
*Assistant Examiner* — Marcel Dion
(74) *Attorney, Agent, or Firm* — Greenberg Traurig, LLP

(57) ABSTRACT

A cutting worktable includes a worktable body have a distal side located away from a cutting tool and a proximal side located adjacent to the cutting tool. The cutting worktable further includes a support frame assembly disposed at the proximal side of the worktable body and used to lift an object to be cut so that the object to be cut is placed on a top surface of the worktable body in an inclined posture. The support frame assembly includes a support roller for contacting the object to be cut and the worktable body is provided with a limiting structure for abutting against the object to be cut and limiting its position. The object to be cut can thus be inclined via the support frame assembly and fixed by the limiting structure. The limiting structure can be in the form of a plurality of placement grooves to achieve placement of the object to be cut at different angles relative to the cutting tool and worktable.

4 Claims, 5 Drawing Sheets

(56) References Cited

U.S. PATENT DOCUMENTS

2009/0277315 A1* 11/2009 Ipatenco ..... B28D 1/047
83/171

* cited by examiner

TABLE TYPE CUTTER AND CUTTING WORKTABLE THEREOF

RELATED APPLICATION DATA

This application claims the benefit of CN 201310208515.6, filed on May 30, 2013, the disclosure of which is incorporated herein by reference in its entirety.

FIELD OF THE DISCLOSURE

The following generally relates to a table type cutter and its cutting worktable and, more particularly, to a table type cutter and its cutting worktable for cutting stone materials such as ceramic files.

BACKGROUND

A table type cutter, as a cutting apparatus for stone materials such as ceramic tiles, usually employs a circular saw blade as a cutting tool. Upon processing, the saw blade is usually fixed, and a work table surface is moved to bring the stone material to be cut towards the blade to perform a cut. However, the worktable surface usually slides only in one direction which is typically a horizontal direction. If a flat panel-like stone material is placed flat on the worktable surface for cutting, a final cutout is a segment of a circular arc due to the contour of the circular saw blade and the thickness of the flat-panel-like stone material (as shown in FIG. 1). In fact, what is desired is an approximately straight line flat cutout. To get a straight line flat cutout, a worker usually needs to manually lift the stone material to incline it relative to the saw blade (as shown in FIG. 2). The ability to obtain such cuts, however, depends on the operator's own expertise and proficiency.

SUMMARY

In order to overcome drawbacks in the prior art, an object of the subject disclosure is to provide a table type cutter and a cutting worktable by which an operator, depending on his expertise, quickly places a stone material relative to the saw blade for cutting to obtain a flat cutout.

To achieve the above object, the present invention employs the following technical solutions:

A cutting worktable comprises: a worktable body comprising a distal side away from a cutting tool and a proximal side adjacent to the cutting tool; and a support frame assembly disposed at the proximal side of the worktable body for obliquely supporting an object to be cut, the support frame assembly comprising a support roller contacting with the object, the worktable body being provided with a limiting structure for abutting against the object and limiting its displacement.

The disclosed cutting system is advantageous in that the stone material can be placed on an incline and be effectively fixed via the turnable support frame assembly and where a plurality of placement grooves are provided to effectively achieve placement of the stone material at different angles. A limiting stop linkable with the support frame assembly can be used as a position limitation device with a slide limiting block on the frame to prevent the support frame assembly from being cut inadvertently by the saw blade.

DETAILED DESCRIPTION

Figure 1:
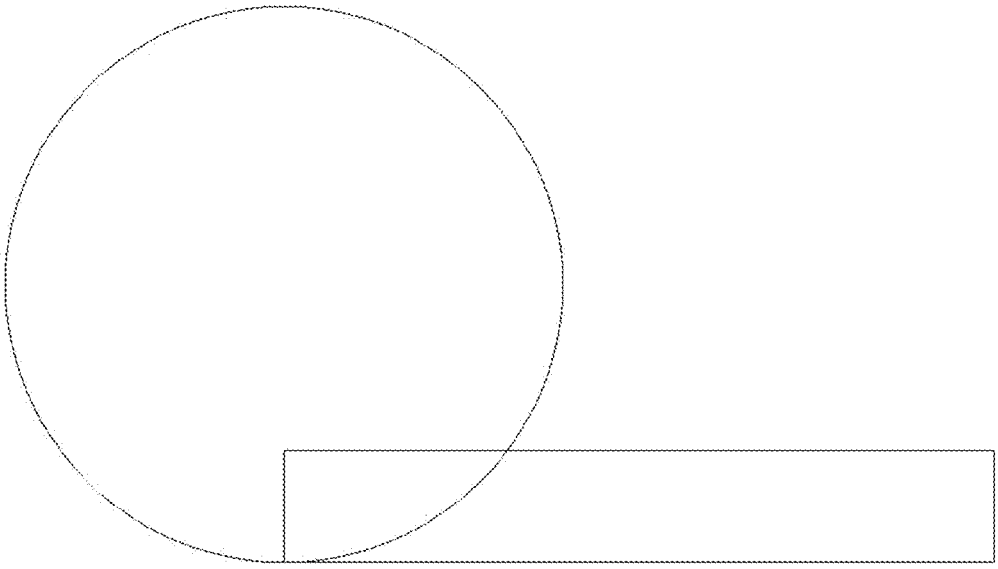
FIG. 1 is a schematic view of a shape of a cutout when cutting is performed with a stone horizontally orientated with respect to the cutting blade.
Figure 2:
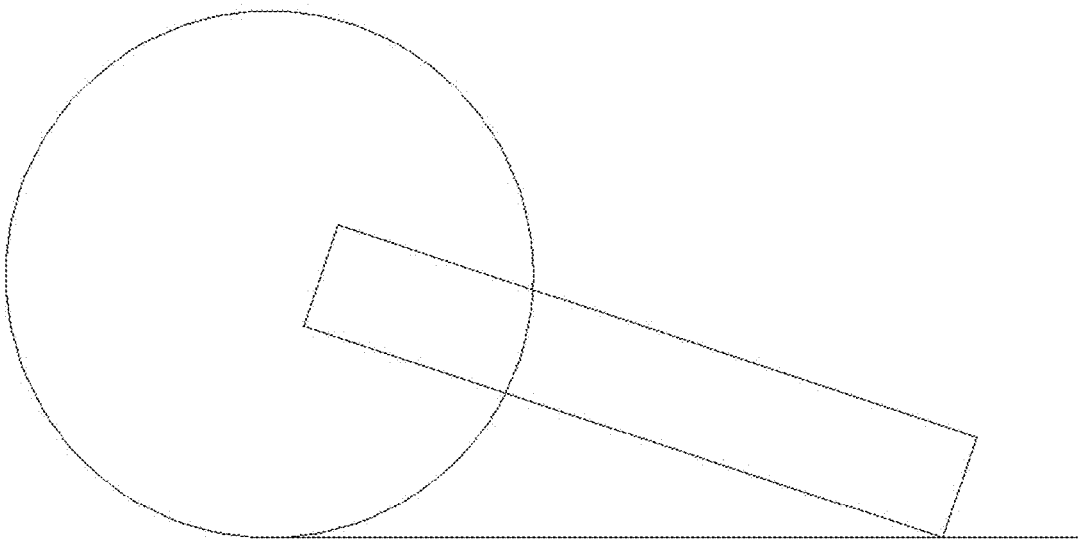
FIG. 2 is a schematic view of a shape of a cutout when cutting is performed with the stone inclined with respect to the cutting blade.
Figure 3:
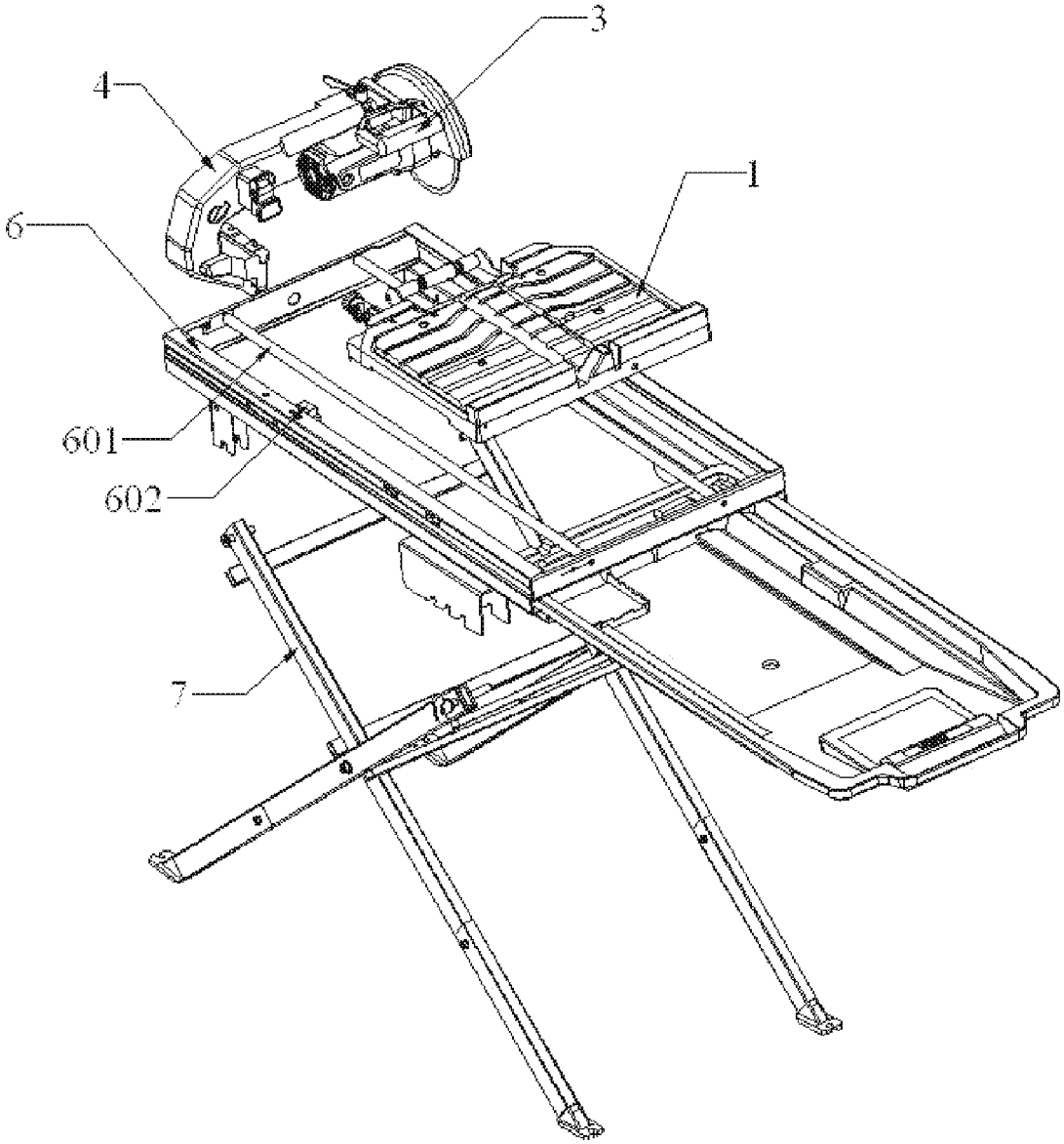
FIG. 3 is a structural schematic view of an exemplary table type cutter constructed according to the description which follows.
Figure 4:
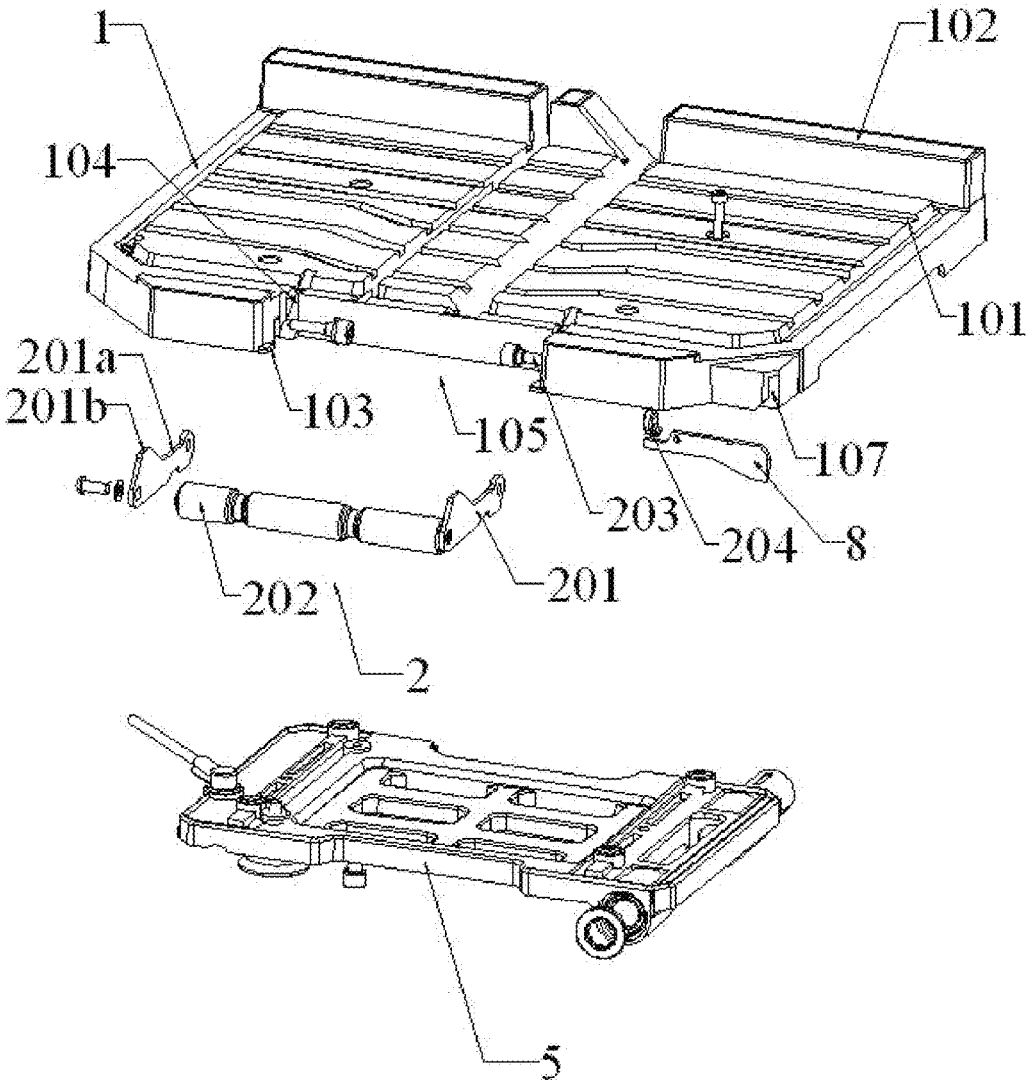
FIG. 4 is a structural schematic view of a cutting worktable and a worktable bracket of the table type cutter shown in FIG. 3.
Figure 5:
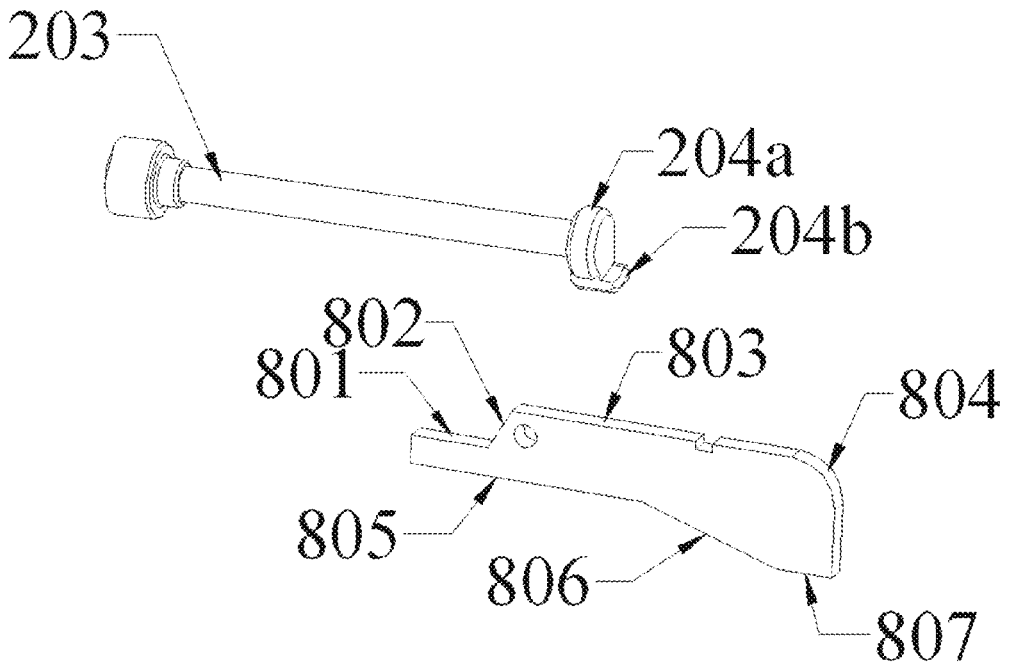
FIG. 5 is a structural schematic view of a driving end and a limiting stop of the cutting worktable shown in FIG. 4.

An exemplary table type cutter will now be described in detail with reference to the figures. Referring to FIGS. 3-5, an exemplary table type cutter comprises a cutting head assembly 3, a support arm assembly 4, a base, a cutting worktable body 1, a worktable bracket 5, and a receiving cavity; wherein the base comprises a frame 6, a foldable support 7, a shaft 203, a driving end 204 and a notch 105.

The cutting head assembly 3 and the support arm assembly 4 constitute a whole which is fixed above the frame 6, wherein the support arm assembly 4 is used to support the cutting head assembly 3. The frame 6 is provided with a slide rail 601. The cutting worktable body 1 and the worktable bracket 5 constitute a whole and form a slide connection with the frame 6 via the slide rail 601, wherein the worktable bracket 5 is located below the worktable body 1 of the cutting worktable. The foldable support 7 is disposed below the frame 6 to support the frame 6 and other parts connected thereon. In order to achieve height adjustment, connection of the foldable support 7 and the frame 6 is not fixed. The portion of the frame 6 for connecting the foldable support 7 may be provided with a plurality of catch positions, and the foldable support 7 can be snap-fit into different catch positions so as to achieve height adjustment of the frame 6, i.e., to achieve height adjustment of the cutting worktable.

The cutting head assembly 3 comprises a cutting tool for cutting. The side of the worktable body 1 away from the cutting tool is a distal end side, and the side closest to the cutting tool is a proximal end side. The cutting tool is a circular saw blade which is rotatable and driven by a motor. The axis of rotation of the circular saw blade is parallel to the axis of a support roller.

A main improvement in the cutting worktable is particularly described below with reference to FIGS. 4 and 5.

The cutting worktable comprises the worktable body 1 and a support frame assembly 2. The worktable body 1 comprises a fence 102, a slot 104 and a limiting structure comprising a plurality of placement grooves 101 formed on the worktable body 1; the support frame assembly 2 comprises an arm 201 and a support roller 202; wherein the top surface of the worktable body 1 is used for positioning and fixing a stone material. In order to achieve inclined placement of the stone material relative to the worktable body 1, the top surface of the worktable body 1 is formed with a plurality of placement grooves 101 and the fence 102 raised at one side edge thereof. A "M"-shaped notch 105 is formed at the other side edge away from the fence 102, and the mounting notch 105 is mainly used to mount and receive the support frame assembly 2.

The placement grooves 101 serve to position and catch one side of the panel-like stone material. Since at this time, the panel-like stone material is inclined, it is preferred that, in order to catch the stone material, the placement grooves 101 consists of a first wall surface inclined towards the fence 102 and a second wall surface which crosses therewith and is inclined towards the notch 105, as a preferred solution.

The support frame assembly 2 comprises two arms 201 and a support roller 202 disposed therebetween, wherein the arms 201 are used to rotatably connect with two projecting portions of the "凹"-shaped notch 105, that is, to form a rotatable connection with the worktable body 1. As a result, the support roller 202 may turn above the worktable body 1 along with the rotation of the arms 201, wherein the axis of the support roller 202 is parallel to a rotation axis of the arms 201, and the two axes are both parallel to the wall surface of the placement groove 101. Thus, one side of the stone material to be cut may be caught by the placement groove 101 and the other side is lifted and supported by the support roller 202 and thereby a non-manual lifting of the stone material is achieved. At this time, feeding the stone material for cutting in an inclined state may be achieved only by translating the cutting worktable, and multi-angle placement may be achieved by appropriately providing the plurality of placement grooves 101; the support frame assembly 2 is pivotably connected to the worktable body 1. The pivot axis of the rotatable connection is parallel to the central axis of the support roller and perpendicular to a cutting direction of the cutting tool.

It is noted that the support roller 202 may be fixedly or rotatably connected to the arms 201. Besides, the support roller 202 may be provided with a plurality of circumferential slots arranged in its axial direction.

As a preferred embodiment, in order to effectively control a movement scope of the support roller 202 and constitute stable support for it, the worktable body 1 is, at a bottom end position of the notch 105, provided with two limiting tabs 103 for limiting a downward turning extremity position of the arms 201. The two limiting tab 103 can limit the downward turning position of the arms 201 and, as such, limit a downward turning position of the support roller 202. In order to limit an upward turning position of the support roller 202 and enable it to be supported by the top surface of the worktable body 1, the top surface of the worktable body 1 adjacent to the notch 105 is formed with slots 104 for limiting an upward turning extremity position of the arms 201. Certainly, the number and positions of the slots 104 are corresponding to the arms 201. The slot 104 has a vertical wall surface and an inclined groove bottom surface. The contour of one side of the arm 201 in contact with the slot 104 is divided into a limiting segment 201*a* for contacting the groove bottom surface to achieve a limit position, and an abutting segment 201*b* in contact with the top surface of the worktable body 1 to achieve supporting. The limiting segment 201*a* of the arm 201 is embedded in the slot 104 and contacts with the groove bottom surface to constitute a position limitation so that it cannot turn upwardly further, while the abutting segment 201*b* contacts the top surface of the worktable body 1 so that the top surface of the worktable body 1 constitutes a support for the arm 201 to enable the support roller 202 to have a load-carrying capability.

According to the above solution, if the cutting worktable indefinitely approaches the cutting head assembly 3, the support roller 20 turned to its top surface has a risk of being cut, and this situation does not exist when the support roller 202 turns away from the top surface. Therefore, it is advantageous that a limiting mechanism linkable with the turning of the support roller 202 is needed in a way that it has a limiting function only when the support roller 202 is turned to the top surface of the worktable body 1.

In order to achieve this purpose, as a preferred embodiment, the cutting worktable is provided with a limiting stop 8 which is extensible out of or retractable into the worktable body along with arm 201. A specific solution may be as follows: the worktable body 1, at a bottom surface at the notch 105, is formed with a downwardly opening receiving cavity, and a cavity wall of the receiving cavity is formed with a mounting through hole, or the underside of the worktable body 1 is wholly an open cavity, i.e., the worktable body 1 is constituted by a top surface and a cavity wall extending downwardly from its periphery, and a mounting through hole is provided at the notch 105. The above two solutions are substantively the same.

The support frame assembly 2 further comprises the shaft 203 enabling the arm 201 to rotatably connect with the worktable body 1. The shaft 203 passes through the mounting through hole of the receiving cavity, wherein one end of the shaft is fixedly connected to the arm 201, and the other end is mounted with a driving end 204 for driving the limiting stop. The limiting stop 8 is rotatably connected in the receiving cavity and its rotation axis is perpendicular to the axis of the shaft 203. The receiving cavity is provided at the side facing a slide limiting stop 602 of the frame 6 with an extension notch 107 for allowing the limiting stop 8 to extend out.

The driving end 204 comprises an end body 204*a* which external contour is a revolution body, and a driving block 204*b* formed on the periphery of the end body 204*a* and used for driving the limiting stop 8 to rotate. The upper edge contour of the limiting stop 8 is formed from inside adjacent to the driving end 204 to outside with following segments in turn: a contact linear segment 801, a transitional linear segment 802, a non-contact linear segment 803 which is parallel to the contact linear segment 801 and higher than the contact linear segment 801 when it is parallel to a horizontal plane, a distal rounded corner 804, wherein the transitional linear segment 802 is inclined between the contact linear segment 801 and the non-contact linear segment 803.

The lower edge contour of the limiting stop 8 is formed from inside adjacent to the driving end 204 to outside with the following segments in turn: a bottom edge inside linear segment 805, a bottom edge transitional linear segment 806 and a bottom edge outside linear segment 807 which is parallel to the bottom edge inside linear segment 805 and is lower than the bottom edge inside linear segment 805 when it is parallel to the horizontal plane. Meanwhile, the frame 6 is provided with the slide limiting block 602 for limiting position.

With the above design, when the support roller 202 is allowed to turn away from the top surface, the driving block 204*b* contacts with the contact linear segment 801 so that one end of the distal rounded corner 804 of the limiting stop 8 lifts up. As such, the bottom edge outside linear segment 807 is received in the extension notch 107, and thus the limiting stop 8 does not play a limiting role; when the support roller 202 is turned above the top surface, the shaft 203 is brought into rotation, the driving block 204*b* leaves the original position due to rotation, and one end of the bottom edge outside linear segment 807 extends downwardly out of the notch 107 due to gravity to achieve position limitation.

The above illustrates and describes basic principles, main features and advantages of the subject cutting table. Those skilled in the art should understand that the above embodiments are not intended to limit the invention that is hereinafter claimed. Rather, all technical solutions obtained by using equivalent substitutes or equivalent variations are intended to fall within the protection scope of the invention that is hereinafter claimed.

What is claimed is:

1. A cutting worktable for use with a cutting tool, comprising a worktable body comprising a distal side that is located away from the cutting tool and a proximal side that is located adjacent to the cutting tool; and a support frame assembly disposed at the proximal side of the worktable body for obliquely supporting an object to be cut, the support frame assembly comprising a support roller contacting with the object to be cut;

wherein the worktable body is provided with a limiting structure for abutting against the object to be cut and for limiting its displacement of the object to be cut during a cutting operation, wherein the limiting structure comprises a plurality of grooves formed on a top surface of the worktable body, wherein the support frame assembly is pivotably connected to the worktable body about a pivot axis, and wherein the pivot axis is parallel to a central axis of the support roller and perpendicular to a cutting direction of the cutting tool, wherein the worktable body further comprises a fence disposed on the distal side of the worktable body and a notch formed on the proximal side of the worktable body for mounting the support frame assembly, wherein the support frame assembly further comprises two arms which are located in the notch and pivotably connected to the worktable body, wherein the support roller is disposed between the two arms, and wherein the support roller is either rotatably or fixedly connected to the arms, and wherein the worktable body is formed with two slots at a top surface of the worktable body adjacent to the notch for limiting upward movement of the two arms, wherein each slot comprises a vertical wall surface and an inclined bottom surface, wherein each of the two arms comprises a side edge being capable of contacting with the slot, and wherein the side edge is provided with a limiting segment contacting with the inclined bottom surface and an abutting segment contacting with the top surface of the worktable body.

2. The cutting worktable according to claim 1, wherein each groove comprises a first wall surface inclined towards the fence and a second wall surface which is inclined towards the notch and intersected with the first wall surface and wherein both the central axis of the support roller and the pivot axis of the arms are parallel to the first and second wall surfaces.

3. A table type cutter, comprising a cutting head assembly comprising a cutting tool for cutting;

a support arm assembly carrying the cutting head assembly;

a base for carrying the support arm assembly; and a cutting worktable supported on the base and comprising:

a worktable body comprising a distal side that is positioned away from the cutting tool and a proximal side that is positioned adjacent to the cutting tool; and a support frame assembly disposed at the proximal side of the worktable body for obliquely supporting an object to be cut, the support frame assembly comprising a support roller contacting with the object to be cut;

wherein the worktable body is provided with a limiting structure for abutting against the object and for limiting its displacement, and wherein the worktable body is formed with two slots at a top surface of the worktable body adjacent to a notch formed on a proximal side of the worktable body for mounting the support frame assembly, the slots for limiting upward movement of two arms located in the notch and pivotably connected to the worktable body, wherein each slot comprises a vertical wall surface and an inclined bottom surface, wherein each of the two arms comprises a side edge for contacting with the slot, and wherein the side edge is provided with a limiting segment contacting with the inclined bottom surface and an abutting segment contacting with the top surface of the worktable body.

4. The table type cutter according to claim 3, wherein the cutting tool is a circular saw blade which is rotatable and driven by a motor and wherein a rotation axis of the circular saw blade is parallel to a central axis of the support roller.

* * * * *